United States Patent [19]

Warehime

[11] 4,346,902

[45] Aug. 31, 1982

[54] HANDBALL GAME UTILIZING PAIRED TETHERED BALLS

[76] Inventor: Norwood R. Warehime, 704 W. 34th St., Baltimore, Md. 21211

[21] Appl. No.: 182,946

[22] Filed: Sep. 2, 1980

Related U.S. Application Data

[63] Continuation-in-part of Ser. No. 62,578, Aug. 1, 1979, abandoned.

[51] Int. Cl.[3] ..... A63B 71/04; A63B 43/00

[52] U.S. Cl. ..... 273/411; 273/58 C; 273/413

[58] Field of Search ..... 273/411, 58 C, 413, 273/414; 46/47, 51, 52

[56] References Cited

U.S. PATENT DOCUMENTS

| | | | |
|---|---|---|---|
| 610,600 | 9/1898 | Davis | 273/58 C |
| 612,173 | 10/1898 | Newton | 273/58 C |
| 672,099 | 4/1901 | Jackson | 273/58 C |
| 2,125,815 | 8/1938 | Rowell | 273/58 C |
| 3,049,352 | 3/1961 | Hancock | 273/58 C |
| 3,095,867 | 7/1963 | Kiyuna | 273/58 C |
| 3,717,348 | 2/1973 | Bower | 273/58 C |
| 3,758,106 | 9/1973 | Liebig | 273/411 X |
| 3,862,757 | 1/1975 | Craig | 273/58 C |
| 4,147,353 | 4/1979 | Moore | 273/413 |

FOREIGN PATENT DOCUMENTS

| | | | |
|---|---|---|---|
| 635367 | 1/1962 | Canada | 273/58 C |
| 347953 | 5/1931 | United Kingdom | 273/58 C |

OTHER PUBLICATIONS

Handball description from an Encyclopedia.

*Primary Examiner*—William H. Grieb

[57] ABSTRACT

The invention provides a novel handball type game and apparatus for singles and doubles play on permanent or temporary type court layout utilizing a pair of special tethered balls of convenient hand size and with high rebound characteristics. Balls are connected by cord with small swivel therein, with spacing between balls roughly approximating shoulder width of wide range of users. Simple measuring and marking means facilitates court layout. Also, existing regular handball, racquetball, and squash courts can be used for game play, however, only one vertical wall is used in novel game. Basic game rules require tethered balls to be thrown one-handedly, that is, both balls released from one hand, and caught on rebound from wall two-handedly, that is, one ball each caught separately and simultaneously. Fault assessments and scoring awards are somewhat similar to regular handball. The paired tethered balls also have many other exercise, recreational, and entertainment uses for a wide range of participants.

9 Claims, 3 Drawing Figures

FIG. 1
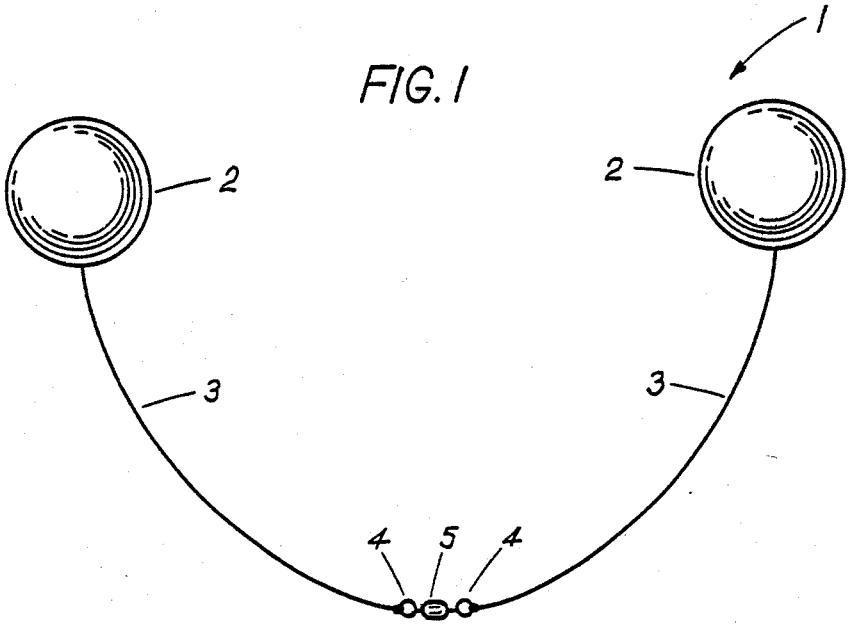
FIG. 2
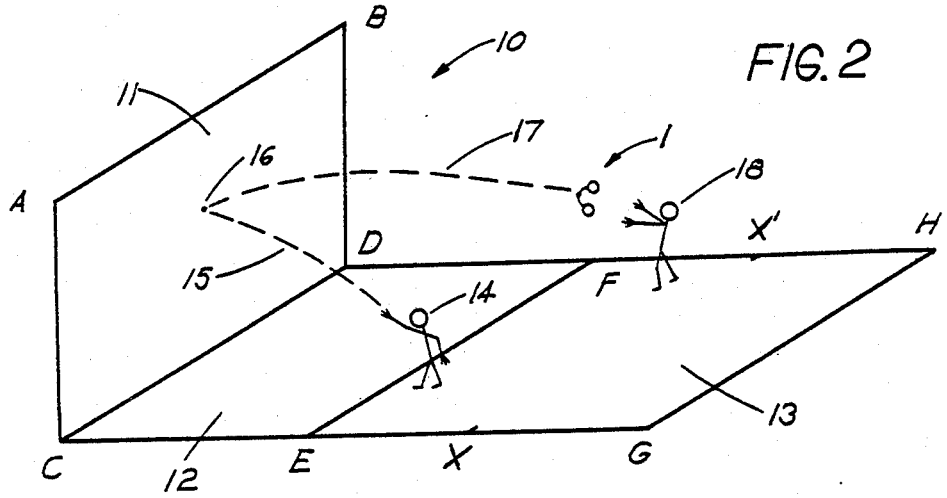
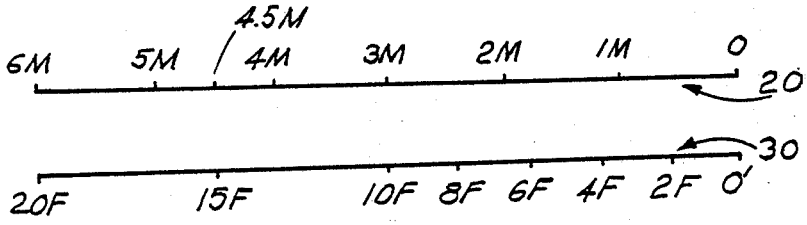
FIG. 3

HANDBALL GAME UTILIZING PAIRED TETHERED BALLS

CROSS REFERENCE OF RELATED APPLICATION

This application is a continuation-in-part of application Ser. No. 062,578 filed Aug. 1, 1979 now abandoned.

TECHNICAL FIELD

The invention relates to a handball type game and apparatus therefor, for individual and team players, played on a court layout, utilizing paired tethered balls which are thrown and caught by hand on rebound from wall, in a prescribed manner, in order to gain maximum point score.

BACKGROUND ART

Regular handball, not to be confused with European team handball, is a dynamic game in which players hit a small rubber ball against a wall with their hands. A brief encyclopedia description of game is sufficient here. Each player tries to hit ball, in conformance with rules, and in such a way, that opposing player cannot return ball properly to wall. Singles and doubles play can be on one-wall, three-wall, or four wall court, with each type court having at least a vertical front wall and a horizontal players area. In general, with reference to a one-wall court, to start a regular handball game, the ball is served from a point at a prescribed distance back from wall by hitting it with the hand on the first bounce after it has been dropped on court floor. The ball must then strike front wall and then rebound to the prescribed horizontal players area to be valid and in play. After proper serve, opposing player must return ball to wall by hit with hand before ball bounces twice on court floor in players area. Play continues after a proper return with alternating hits of ball by players until a fault is committed which results in either a loss of ball serve or award of a point score, depending on game situation. Only the serving player or team can score a point. Faults are accessed for a variety of reasons. First player or team with 21 points wins game. A match is usually decided on first 2 out of 3 game wins. Regular handball play on three-wall and four-wall type courts permits ball play on said number of walls plus additional play on ceiling of latter type court. Since the newly invented game utilizes paired tethered balls in place of the one small rubber ball for game play, only the front wall and the horizontal players area of any type court are considered suitable for the novel game play due to the added degree of difficulty of play imposed by the tethered balls.

Paired tethered balls have been utilized in the past for a variety of games and toys. Relevant prior art includes U.S. Pat. No. 610,600 in which two hollow balls with squared holes therein are connected by string with handle in middle to facilitate swinging of balls in opposite directions and creation of sound effects; U.S. Pat. No. 612,173 in which two balls are connected by an elastic strip, whereby balls are tossed onehandedly, one after the other, with the elasticity of the strip returning balls to hand; U.S. Pat. No. 672,099 in which two balls are connected by an elastic or non-elastic cord which in turn is passed through an eyelet of a ring which is placed on a finger of the user. One ball is thrown from the user's hand and the other ball is drawn to the hand by counterweight effect, thus creating a continuous type ball movement play; U.S. Pat. No. 2,125,815 in which paired balls are formed by two pairs of hemispheres with holes and slots therein, connected by cord, with handle in middle. Device is twirled to create visual and sound effects; U.S. Pat. No. 3,095,867 in which two balls are connected by a line with a frictionally engageable member in middle of line. Said member is engaged to receptive member on end of a projector whip. Balls are cast by crack of whip for amusement. U.S. Pat. No. 3,049,352 in which two small balls are connected by a cord of relatively short length to form a game device which is thrown and caught by the players with a special ended type stick; U.S. Pat. No. 3,717,348 in which two balls are connected by an elastic connector which has a small gripping tab in middle. Ball set represents a missile which is thrown by hand at various types of branched stick targets for point scores; British Pat. No. 347,953 in which two balls connected by a long cord are used as a projectile for throwing with hand from a twirling motion in attempt to entwine tethered balls on a pole for point score; Canadian Pat. No. 635,367 in which two small rubber balls connected by a relatively short cord are used as a projectile to be thrown and caught by a special pronged stick in game play. Probably, the most relevant patents cited above are U.S. Pat. No. 672,099 and British Pat. No. 347,953. In the former patent, the balls can be of rubber but no mention is made of ball size, weight, or rebound characteristics. Also, no mention is made of any specific length of ball connecting cord, although as indicated on drawing, the cord length is well beyond that considered for tethered balls of current invention. About the same can be said for the British patent. Balls are soft rubber with no ball weight or rebound characteristics mentioned, but according to scale shown on drawing, balls are about 4 inches (10.2 cms) in diameter, and cord length is about 36 inches (83.8 cms), which makes both measurements well beyond those considered for tethered balls of current invention. In all cited prior art patents, no tethered balls are intended for convenient ambidextrous handling in toss, catch, and rebound play. Furthermore, use of a swivel in connecting cord of tethered ball to prevent undesirable twisting of cord was not considered in any cited prior art, but is considered in current invention.

DISCLOSURE OF INVENTION

The invention provides a novel handball type game and apparatus therefor, for individuals and team players, played on permanent or temporary type court, utilizing a pair of special tethered balls, whereby balls are thrown one-handedly, that is, both balls are thrown from one hand of a player, and are to be caught on rebound from a vertical court wall two-handedly, that is, one ball each caught separately and simultaneously in the hands of an opposing player. Game play is continuous. Game instructions and rules cover court layout details, playing procedure, fault assessments and scoring awards, and winner determination. Details of fabrication of paired tethered balls are as follows: ball type can be of resilient organic material such as plastic, rubber, or sponge rubber, of solid or hollow construction, with balls having a diameter of about $1\frac{5}{8}$ to $2\frac{7}{8}$ inches (4.2 to 7.4 cms.), with individual ball weight of about 1.1 to 3.5 ounces (31 to 100 gms), and with balls having a relative vertical rebound characteristic value of about 50 to 90 percent when dropped onto a smooth and level concrete surface from a height of 50 inches (127.0 cms). The paired balls are connected together by a strong, flexible, inelastic cord having a length between balls of about 10 to 20 inches (25.4 to 50.8 cms). A swivel can be inserted and secured in connecting cord to prevent undesirable twisting of cord and to provide freer movement of balls in tethered arrangement.

Game play with novel tethered balls provides a safe, dynamic, and challenging competitive recreation which is beneficial in the development of hand-eye coordination, ambidexterity, and general ball handling skills, all at an inexpensive cost, since game can be played on many existing surfaces, indoors or outdoors, with minimum of surface marking requirements and apparatus. Various measurement and court marking means are suggested for both permanent and temporary use type courts.

BRIEF DESCRIPTION OF DRAWINGS

The details of the invention will be described in connection with the accompanying drawings, in which FIG. 1 is a side view of the paired tethered balls with swivel in connecting cord;

FIG. 2 is a perspective view of a game court layout showing stick figure players in process of throwing and catching tethered balls; and FIG. 3 is a schematic representation of a metric and a foot unit measuring means with scale markers to facilitate game court layout.

DESCRIPTION AND BEST MODE OF CARRYING OUT INVENTION

Referring to the drawings, FIG. 1 shows the preferred embodiment of the paired tethered balls, in which the numeral 1 generally indicates the paired tethered balls and 2 indicates the two individual balls which are connected by the cord member 3. A swivel comprising eyelets 4 and swivel body 5 is inserted and secured in the connecting cord 3. Any suitable means may be used to connect the balls to the cord, but preferably in a way in which no portion of the securing means is visible on the exterior of the balls. Means of connecting cord 3 to swivel eyelet 4 should provide a compact and secure connection. One satisfactory way to make the connection is to use a nylon cord with a loop through swivel eyelet followed by a one knot tie and the singeing of the frayed cord end which results in a molten type seal of the nylon on the knot. Requirements for the balls 2 are fairly critical. The balls should be made of highly resilient organic material such as plastic, rubber, or sponge rubber, and of either solid or hollow construction. The balls should have a diameter which facilitates easy throwing of both tethered balls with one hand simultaneously, and easy catching of both tethered balls ambidextrously with two hands, individually and simultaneously. Ball diameters of about $1\frac{5}{8}$ to $2\frac{7}{8}$ inches (4.2 to 7.4 cms) have been found to be satisfactory. With varying ball materials, type of construction, and diameters, individual ball weights should range from about 1.1 to 3.5 ounces (31 to 100 gms). The balls 2 should have excellent bounce or rebound characteristics. Many types of balls have been field tested to determine range suitable for the paired tethered balls 1 used in the novel handball game. Balls found suitable have a relative vertical rebound characteristic value of about 50 to 90 percent when dropped onto a smooth and level concrete surface from a height of 50 inches (127.0 cms). Material found to be satisfactory for ball connecting means includes inelastic nylon cord or braid, types which are commonly used for fishing lines and construction worker's chalk lines. A small swivel of brass or stainless steel, commonly used in fishing lines, provides an adequate swivel means in connecting cord. It has been found through extensive field testing of paired tethered balls that a swivel in the connecting cord practically eliminates undesirable twisting of cord, while at the same time reduces cord wear, and provides freer individual ball movement of the tethered balls. Connecting means length between balls 2, including length of swivel, should roughly approximate the shoulder width of the range of player types being paired tethered balls. This range includes smaller framed children of 8 years of age at the lower extreme and the larger adult types at the upper extreme. Accordingly, connecting means length between balls should be about 10 to 20 inches (25.4 to 50.8 cms).

FIG. 2 shows the preferred embodiment of the game court layout indicated generally by numeral 10 in which letters are used to indicate various court lines and intersections, and numerals are used to indicate the court areas. The court is referred to as a one-wall court, with the vertical wall area indicated by 11 and bounded by line pattern ABDC. The adjacent horizontal area 12 bounded by line pattern CDFE is referred to as the set-back area. The horizontal area 13 bounded by line pattern EFHG which is remote from wall is referred to as the players area. The letters X and X' at the hash marks on the sides of the players area are midpoints of the lines EG anf FH respectively, and are used to determine the back half of the players area from which the tethered balls are served in game play. In addition to the court layout shown in FIG. 2, two stick figures (players) are shown in a typical singles game play sequence of throwing and catching the paired tethered balls. The player 14 has just thrown balls 1 from the left side of players area with both balls being released from one hand. Balls have taken a path 15 to wall and have rebounded from wall at point 16 with a path 17. Player 18 on right side of players area is shown preparing to catch balls 1 with his two hands, separately and simultaneously.

FIG. 3 shows two types of measuring strings used to facilitate layout of game court. Numeral 20 generally represents a metric measuring string 6 meters long, with an initial marker shown at start of scale as 0, and further markers shown at exact meter points as 1M, 2M, 3M, 4M, 5M, and 6M, plus an additional marker shown at the 4.5 meter point as marker 4.5M. Numeral 30 generally represents a foot unit measuring string 20 feet long with an initial marker shown at start of scale as 0', and further marks shown at exact 2 feet points as 2F, 4F, 6F, 8F, and 10F, plus an additional marker shown at the 15 feet point as marker 15F. Markers can be in the form of small tags fastened to string, or simply as colored indicators on string. For simplicity sake, the court layout measurements of 6 meters and 20 feet are considered equivalent. The same applies to the 4.5 meters and the 15 feet measurements.

Following detailed descriptions of the paired tethered balls and court layout measuring means and a general description of the court layout itself, it is now fitting to describe a court layout in detail in order to discuss actual novel game play. Court layout as shown in FIG. 2, using measuring means shown in FIG. 3 can be laid out in the following manner. First, assume a reasonably smooth and vertical wall and a reasonably smooth and level horizontal surface is available for layout. For this example, further assume vertical and horizontal surfaces to be of sufficient size and to be wood or concrete, materials that can readily be marked in a variety of ways, such as with paint, chalk, or adhesive tape. For simplicity sake, measurements will be made using the metric measuring string indicated by numeral 20 in FIG. 3. Using metric string, layout vertical wall area 11 by measuring and marking lines AB and CD as 6 meters long, and lines AC and BD as 4.5 meters long. All angles formed by lines should be right angles. The measuring string can also be used to layout right angles by using the commonly known 3,4,5 side length relationship of a right triangle. The line CD should be the line of intersection of the vertical and horizontal surfaces. Next layout horizontal set-back area 12 by measuring and marking lines CE and DF as 4.5 meters long, and line EF as 6 meters long, with all angles formed being right angles. Next layout horizontal players area 13 by measuring and marking lines EG and FH as 6 meters long, and line GH as 6 meters long, and again with all angles formed being right angles. The hash marks X and X' are measured and marked on midpoints of lines EG and FH respectively. Court layout is completed.

It should be stated at this point that the critical area of the court layout is the horizontal players area 13 bounded by the line pattern EFHG which is an area 6×6 meters (or 20×20 feet) square. The vertical wall area 11 and the horizontal set-back area 12 are best thought of as reference areas as will be evident from the following game play description.

Assume singles game play, that is, one against one type play, and determine which player is to serve paired tethered balls by toss of coin. Serving player positions himself anywhere within back half of players area 13. Opponent can be positioned anywhere he chooses. With proper warning, server then throws balls one-handedly, that is, both balls are released from one hand. Balls must hit wall and rebound to the general vicinity of players area 13 where opponent must catch balls two-handedly, that is, one ball each caught separately and simultaneously with hands before ball(s) are allowed to strike surface within players area 13. If opponent of server thinks balls will not land within players area, he can forgo catch attempt. If either or both balls land outside players area, serve is invalid, and a fault is assessed against server. Only one serve is allowed, so in this case, serve is lost. If serve rebound appears valid, opponent must make proper two-handed catch and return balls to wall with proper one-handed throw. Players are allowed a maximum of 3 steps distance and 5 seconds time for making transition between catching and throwing actions. Players can move anywhere in general area of court. Throws and catches and player positions are not restricted to the players area 13, but whenever the balls are allowed to land within that area, a fault is assessed to the player who was supposed to catch balls. In game play, if a player misses both balls or makes an illegal catch involving both balls, he is assessed a fault. If a player misses one ball in a catch attempt, that is, he makes a 1-ball catch, he is assessed a ½ of a fault, but game play continues within the distance and time limits stated previously. The general rule to remember is that players are accessed a fault for one 2-ball miss or for two 1-ball misses. Only the server can get a point score when opponent is assessed a full fault. If server makes a fault, he loses his serve, but no point score is awarded. If opponent of server makes a fault, server is awarded a point score and he continues with service until he makes a full fault.

A summary of the point score and service rule is as follows:

A. One point is awarded server when:

1. Opponent misses 2 balls or makes a double illegal catch on one catch try.
2. Opponent misses 1 ball or makes an illegal catch on two catch tries. (A total of two 1-ball misses). Catch must be clean and not against body.
3. Opponent lets one or both balls land inside of payers area of court.
4. Opponent fouls server by blocking action or other illegal game play.
5. Opponent hits server with ball(s).
6. Opponent throws balls and rebound lands with one or both balls outside of players area of court.
7. Opponent takes more than 3 steps with balls or takes more than 5 seconds time before making return throw of balls, or makes any other improper throw. Throw must be one-handed. Throw using cord is not allowed.

B. Serve is lost if server commits any of the faults listed above. Opponent then makes serve to start game play again. Only one serve is allowed. Serve must be from back half of players area of court. Proper warning must be made before balls are served. Serving player retains that right until he commits a fault. Only serving player can be awarded a point score.

Game play continues until a player gets winning total of 21 points. A match is usually decided on first 2 out of 3 game wins. Doubles play is essentially the same as singles play, except that team players alternate serve on each new serve sequence.

Game can be played on any type of existing handball, racquet ball, or squash court. Use only vertical front wall and equivalent of players area of existing court, or measure and mark new temporary players area. Use adhesive tape or chalk for markings. For game play where players area is on dirt, sand, or grass, markings can be made with a white powder or with a rope to form a rectangular (square) players area with holddown pins at the four corners. For a permanent court layout on a hard surface for the novel game, markings should be painted lines.

In addition to subject game, the paired tethered balls have many other exercise, recreational, and entertainment uses for individuals, couples, teams and groups, both indoors and outdoors. Paired tethered balls can be varied in design, and court layout dimensions can be varied to accommodate a variety of types and age groups of users.

I claim:

1. A handball type game and apparatus therefor, for individual and team players, played on a court layout, comprising a horizontal and a vertical playing surface means including a game area means, and a pair of tethered spherical balls, said tethered balls being especially suited for one of said players to make one-handed throws, that is, both of said tethered balls are thrown simultaneously from one hand, and also for one of said players to make two-handed catches, that is, one ball each of said tethered balls is caught separately and simultaneously in the hands of one of said players, each ball of said pair of tethered spherical balls being substantially identical in nature and consisting substantially of resilient and pliable organic material, each said ball having an optimum diameter of about 1⅝ to 2⅞ inches (4.2 to 7.4 cms), each said ball having an optimum weight of about 1.1 to 3.5 ounces (31 to 100 gms), each said ball having an optimum relative vertical rebound characteristic value of about 50 to 90 percent, said tethered balls being connected together by a strong, flexible, inelastic cord, said cord having an optimum length between individual balls of about 10 to 20 inches (25.4 to 50.8 cms), whereby said players normally utilize said tethered balls on said court layout for throwing, catching, and rebound play, in a prescribed manner, in order to gain maximum point score.

2. Game and apparatus of claim 1 wherein said tethered balls have a swivel means inserted and secured in said connecting cord, thus forming an integral part thereof.

3. Game and apparatus of claim 1 wherein said game area means includes measuring means to establish said game area means.

4. Game and apparatus of claim 1 wherein said game area means includes a game area marking means.

5. Game and apparatus of claim 1 wherein said game area means comprises one vertical rectangular area and two horizontal rectangular areas, all said rectangular areas being interconnected on said playing surface means.

6. Game and apparatus of claim 1 wherein said game area means comprises at least one prescribed area marked on the vertical playing surface means and at least one prescribed area marked on the horizontal playing surface means.

7. Game and apparatus of claim 1 wherein said game area means comprises at least one prescribed area marked on the horizontal playing surface means.

8. Game and apparatus of claim 1 wherein each of said balls is hollow.

9. Game and apparatus of claim 1 wherein each of said balls is solid.

* * * * *